United States Patent [19]

Lestraden

[11] 4,182,049

[45] Jan. 8, 1980

[54] METHOD AND APPARATUS FOR THE CONDITIONING OF PRODUCTS

[76] Inventor: Jacobus J. W. Lestraden, 4, Nachtegaallaan, Sassenheim, Netherlands

[21] Appl. No.: 773,973

[22] Filed: Mar. 3, 1977

[30] Foreign Application Priority Data

Mar. 4, 1976 [NL] Netherlands ..... 760247

[51] Int. Cl.[2] ..... F26B 3/06

[52] U.S. Cl. ..... 34/34; 34/38; 34/43; 34/222; 34/229; 98/55

[58] Field of Search ..... 98/52, 53, 55; 34/34, 34/38, 222, 229, 43, 195, 196, 197

[56] References Cited

U.S. PATENT DOCUMENTS

| | | | |
|---|---|---|---|
| 1,140,009 | 5/1915 | Tashjian | 34/34 |
| 2,278,571 | 4/1942 | Skinner | 34/38 |
| 3,129,071 | 4/1964 | Meredith | 34/34 |
| 3,603,380 | 9/1971 | Corhanidis | 98/52 |
| 4,021,928 | 5/1977 | Johnson | 34/38 |

FOREIGN PATENT DOCUMENTS

| | | | |
|---|---|---|---|
| 492570 | 4/1930 | Fed. Rep. of Germany | 34/229 |
| 523723 | 4/1921 | France | 34/196 |
| 457836 | 6/1950 | Italy | 34/196 |
| 31819 | 2/1921 | Norway | 34/195 |

*Primary Examiner*—John J. Camby
*Assistant Examiner*—Larry I. Schwartz
*Attorney, Agent, or Firm*—Morgan, Finnegan, Pine, Foley & Lee

[57] ABSTRACT

This application relates to a method for conditioning products that are stacked in containers which are partially open and in which there is disposed between two containers stacked one on top of the other and close to a side wall of these containers a ventilator unit to produce an air current in the gap between the containers and which extends into the partially open containers. The ventilator may be attached removably to the containers by suitable means and is provided with an inlet or outlet nozzle that has a height which corresponds to the gap between the containers.

2 Claims, 2 Drawing Figures

METHOD AND APPARATUS FOR THE CONDITIONING OF PRODUCTS

The invention relates to a method for conditioning products placed in partially open stacked containers, which containers are stacked mutually spaced above each other and side by side.

Methods are known of placing these containers in closed spaces into which cooled, warm or dry air is introduced in order to cool, freeze or dry the products or subject them to a combined treatment. Methods are also known of subjecting cetain products exclusively to a current of air in order to dry these products in this manner, without being in a airconditioning space.

An important aspect of these methods of conditioning these products is to obtain an air current as regular as possible between and along these products in order to subject all of them to a uniform current of air whether or not they are placed in separate containers.

Installations are known which make use of a central ventilator placed in a ventilator housing and provided with a number of air outlet ducts, which ducts are provided with openings at the spot where the stack of containers leaves spaces open for the supply of air. In practice it appeared that these installations present considerable difficulties as regards their size and as regards their air distribution characteristic, as a result of which they are especially unsuitable for the conditioning of products which are situated in a number of containers placed side by side and also stacked in the vertical direction. The possibility that these products do not in the least satisfy the requirements after the treatment is performed is then very great and the field of application is thereby badly restricted.

The object of the invention is to provide a method and apparatus where these disadvantages do not occur, which method guarantees an effective distribution of air in all partially open containers and can be realized in a simple manner.

According to the invention, the method is characterized in that at least between two containers stacked above each other and close to a sidewall of the containers there is a ventilator unit which produces an air current directly in the gap between the containers stacked above each other, the air current extending into the partially open containers adjoining the gap.

The installation for implementing this method comprises by preference at least one ventilator unit which can be removably affixed to the containers by means of a bracket and which ventilator unit is provided with an inlet or outlet nozzle, the height of which corresponds to the gap between the containers. In another type of the installation according to the invention, the ventilator units can be mounted adjustably in height on a vertical supporting member sliding along the supporting floor.

The invention will be explained, exclusively by way of example, with the help of the embodiments illustrated in the drawings.

Figure 1:
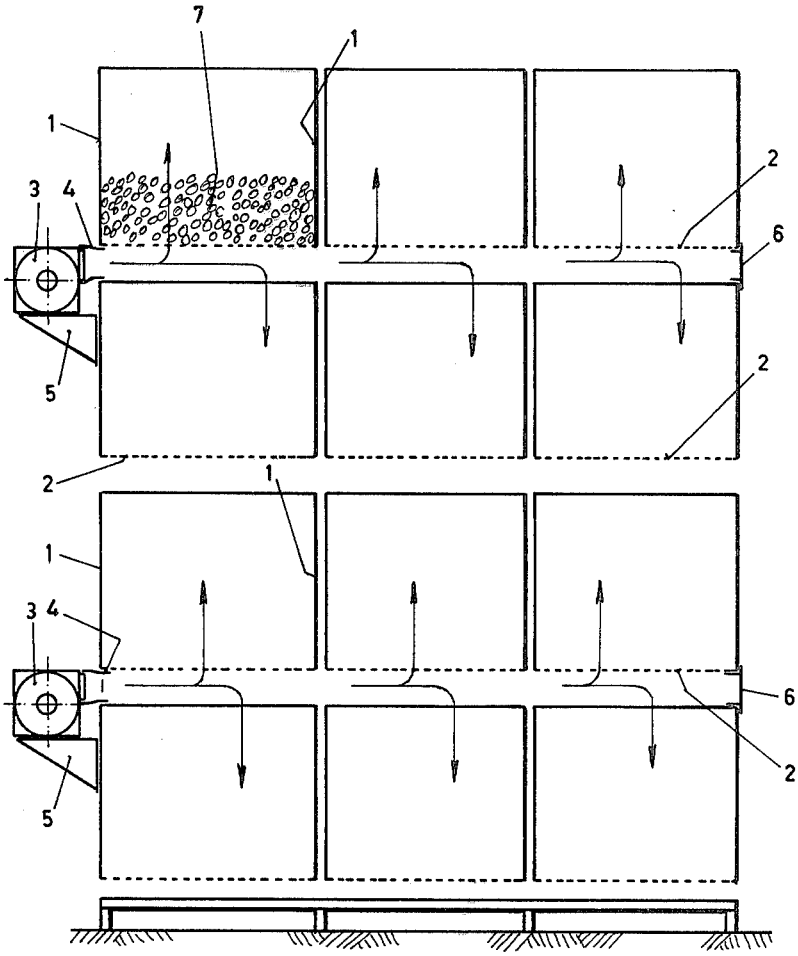
FIG. 1 shows a stack of containers provided with two separate ventilator units.

In FIG. 1, reference 1 indicates the containers, each of which is provided with a perforated bottom 2. The containers are stacked above each other and side by side and the intention is that an air current be produced such that the products 7 in the containers are subjected in a regular manner to a current of air treated elsewhere or derived directly from the atmosphere. In other words, the stack of containers 1 can be placed, for example, in a cooling room or can be outside in the free atmosphere.

Situated between two horizontal rows of containers lying above each other and adjacent the side wall of two containers 1 there is a ventilator unit 3. This ventilator unit is provided with a nozzle 4 protruding into the gap between two containers placed above each other, the construction of the nozzle being such that its height can be adjusted within certain limits, manually or automatically, to the height of the gap. This can be done, for example, by providing the nozzle with an elastic top plate or with a hinged top plate under spring pressure so that the nozzle is clamped in the gap. All the containers are mounted, for example, on a pallet the top of which is perforated.

The ventilator unit is provided further with a bracket 5 with the aid of which this unit 3 is propped up against the side wall of the container and can thus be mounted removably in a simple manner.

In operation, an air current as indicated by the arrows is produced in the example shown when sealing strips 6 are placed at opposite sides of the free space. These sealing strips have a horizontal flange which enables them to be clamped in the open gap in a simple manner. The air currents indicated by the arrows bring about a uniform distribution of air between the products 7 situated in the containers, whereby optimal results can be obtained.

Figure 2:
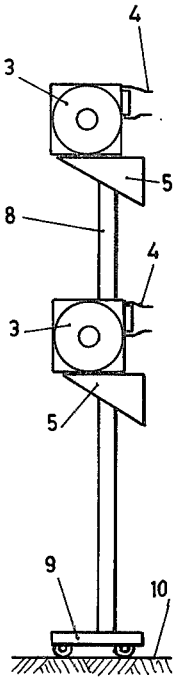
FIG. 2 shows an installation provided with ventilator units mounted on a vertical stand.

FIG. 2 shows an installation in which members corresponding to the ventilator units 3 of FIG. 1 are mounted slidably in the vertical direction on a vertical column 8 which is mounted on a base member 9 movable in the horizontal direction along a floor on which the container stacks are located. By providing the brackets 5 of the units of FIG. 1 with a bush fitted with a set screw, the units can be used in the manner shown in FIG. 1 and can be simultaneously pushed on to the column 8 and then secured in the desired place on this column by means of the set screw.

By means of the above-described invention it is possible to obtain in a simple manner a uniform air current through the containers, while the technical means for this purpose are simple to construct. It should be noted that in certain cases it may be profitable to reverse the direction of the air current, the nozzle 4 then acting as a suction nozzle.

I claim:

1. Method for conditioning products situated in stacked, partially open containers comprising stacking said containers in mutually spaced relationship one on top of the other and side by side and forming a gap between the containers stacked one on top of the other, disposing at least one ventilator unit at least between two containers stacked one on top of the other at one end of and directly in said gap between said containers while sealing said gap at the opposite end, said ventilator unit being removably attached to the said containers by means of fixing members and having an inlet or outlet nozzle which is adjustable with respect to height and permitting the height of said nozzle to adjust itself and link up with the upper and lower limits of said gap, and producing directly in said gap with said ventilator unit an air current which extends through said gap and into said partially open containers adjoining said gap and directly on to said products.

2. Method for conditioning products situated in stacked, partially open containers comprising stacking a plurality of said containers in mutually spaced relationship one on top of the other and side by side in a plurality of rows and forming a plurality of gaps between the containers stacked one on top of the other, disposing a plurality of ventilator units at least between two containers stacked one on top of the other at one end of and directly in each said gaps between said containers while sealing said gaps at the opposite end, each of said ventilator units being removably attached to the said containers by means of fixing members and having an inlet or outlet nozzle which is adjustable with respect to height and adjustably mounted on a vertical supporting member movable along a supporting floor and first adjusting each said ventilator on said vertical supporting member and bringing each nozzle into line with each one of said gaps and then permitting the height of each nozzle to adjust itself and link up with the upper and lower limits of each one of said gaps, and producing directly in each of said gaps with each of said ventilator units an air current which extends through each of said gaps and into said partially open containers adjoining each of said gaps and directly on to said products.

* * * * *